United States Patent [19]

Hetherington et al.

[11] 4,175,702

[45] Nov. 27, 1979

[54] AIR NUCLEATING SPARY GUN

[75] Inventors: Robert D. Hetherington, Sunland; David W. Goelz, Burbank, both of Calif.

[73] Assignee: Poly-Glas Systems, Sun Valley, Calif.

[21] Appl. No.: 867,654

[22] Filed: Jan. 6, 1978

[51] Int. Cl.[2] ..... B05B 7/08; B05B 15/02

[52] U.S. Cl. ..... 239/113; 239/415; 239/419.3; 239/432; 239/528

[58] Field of Search ..... 239/113, 296, 311, 369, 239/371, 407, 413–415, 416.1, 417.5, 419.3, 422, 424.5, 428–430, 432, 527, 528

[56] References Cited

U.S. PATENT DOCUMENTS

| | | | |
|---|---|---|---|
| 1,426,697 | 8/1922 | Windle | 239/419.3 |
| 2,692,764 | 10/1954 | Hanson | 239/428 X |
| 3,033,472 | 5/1962 | Shelton | 239/419.3 X |
| 3,458,138 | 7/1969 | Yankee | 239/422 X |
| 3,589,607 | 6/1971 | Wolf et al. | 239/424.5 X |
| 3,659,790 | 5/1972 | Gelin | 239/422 X |
| 3,923,246 | 12/1975 | Cloutier et al. | 239/2 S |
| 4,123,007 | 10/1978 | Gardner | 239/419.3 X |

*Primary Examiner*—Johnny D. Cherry
*Attorney, Agent, or Firm*—Jessup & Beecher

[57] ABSTRACT

A forced air nucleating jet gun assembly comprised of a nozzle body designed to atomize material at the nozzle for external mixing with a catalyst which is atomized in the handle body of the gun assembly. The nozzle body incorporates passageways for delivering atomizing air deflected counter to the path of a material delivered to a fluid tip. The fluid tip assembly is designed to deflect atomizing air into the path of the material for low-pressure delivery of resin to the jet. An air control valve is incorporated into the nozzle body and is operated sequentially with the material valve to purge the fluid tip prior to delivery or supply of material for atomizing by air. The forced air nucleating system incorporated in the nozzle body delivers resin and air or atomized resin through the fluid tip external mixing with catalyst.

23 Claims, 8 Drawing Figures

AIR NUCLEATING SPARY GUN

BACKGROUND OF THE INVENTION

This invention relates generally to plural component spray systems, and more particularly relates to a gun which provides external mixing of two components such as catalyst and resin.

In present plural component delivery and spraying systems, one or more of the components is delivered under high pressure to a nozzle for mixing with a catalyst. In addition to the inherent problems of utilizing airless high-pressure delivery systems, assuring a homogeneous mixture is difficult and cross-over of components can occur because of high pressures. The flushing with an expensive flammable solvent is necessary because with internal mixing there is a great chance of resin setup inside the gun from cross-feeding to catalyst passages which could severely damage the gun, or at least render the gun useless until clogged passageways are cleared. After resin has set up, cleaning can be a difficult and time-consuming process if not altogether impossible.

SUMMARY OF THE INVENTION

The purpose of the present invention is to provide a plural component spraying system having an external mix spraying of plural components.

This invention is related to and can be used with the plural component spraying system of Charles R. Gardner, disclosed in U.S. patent application Ser. No. 739,667, filed Nov. 8, 1976, now U.S. Pat. No. 4,123,007.

The present invention provides an improvement in the invention disclosed in the above-identified application by providing a nozzle body assembly adaptable to the handle body of that invention which permits external mixing of plural components, such as catalyst and resin. The nozzle body of the present invention provides a passageway and control valve for delivering air to the material delivered to the nozzle at the outlet to the nozzle. In addition, the nozzle body assembly includes a fluid tip nozzle assembly having a deflecting means for deflecting air counter to the path of the material being delivered to the nozzle for atomizing the material prior to exiting from the nozzle. The forced air control valve incorporated into the nozzle body assembly is constructed to operate sequentially with a resin material delivery valve and permits purging of the fluid tip assembly prior to delivery of resin and after each use.

With the nozzle body assembly of the present invention, air is delivered to the fluid tip nozzle when the gun trigger is operated prior to delivery of the material or resin. Thus, the first position of the trigger purges the entire system with air. A second position of the trigger delivers material to the nozzle body assembly for atomizing by air just before exiting from the fluid tip. As the material enters the passageway adjacent to the fluid tip nozzle, the air delivery system forces air into the path of the material atomizing or nucleating it. The atomized material is then delivered to the fluid tip or jet for external mixing with a catalyst. Incorporated into the fluid tip assembly is a stabilizing vane which smooths out the turbulent flow of the resin or material caused by the nucleating air, producing an even spray to assure homogeneous mixing of catalyst and resin externally.

The important unique features of the present invention are a nozzle body assembly incorporating an air delivery system to provide forced air nucleation of a material such as resin before the material exits from a fluid tip for external mixing. Incorporated into the nozzle body assembly is a fluid tip assembly having conical means for deflecting air delivered to the nozzle body assembly into the path of resin or other material to atomize the material. The fluid tip assembly includes a stabilizing vane for smoothing out the flow after nucleation to assure a homogeneous spray and mix externally. The system also includes an air valve operated sequentially and prior to the operation of the material valve to purge and clean the fluid tip nozzle assembly before and after delivery of resin or other material.

Accordingly, it is one object of the present invention to provide a plural component spray gun which permits external mixing of plural components.

Another object of the present invention is to provide a plural component spray gun in which the plural components are delivered at low pressure.

Yet another object of the present invention is to provide a plural component spray gun having forced air nucleation of one of the materials near the fluid tip exit.

Another object of the present invention is to provide a plural component spray gun having external mixing at low pressure which eliminates the need for expensive flammable solvents for flushing.

Still another object of the present invention is to provide a plural component spray gun in which the system is purged with air prior to and after delivery of the plural components.

Yet another object of the present invention is to provide a plural component spray gun having an air delivery system in the nozzle body for nucleating resin immediately before delivering it to the fluid tip for external mixing.

Other objects, advantages and novel features of the invention will become apparent from the following detailed description of the invention when considered in conjunction with the accompanying drawings wherein like reference numbers identify like parts throughout.

DETAILED DESCRIPTION OF THE PREFERRED EMBODIMENT

Figure 1:
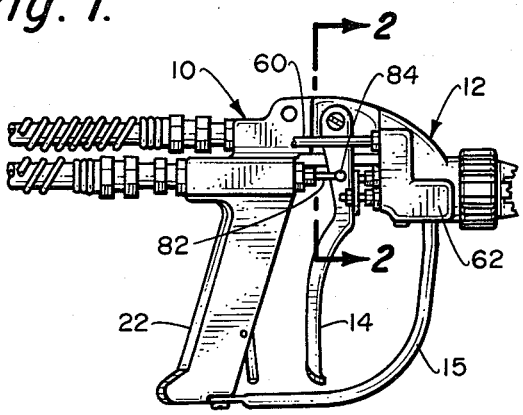
FIG. 1 is a side view of a plural component spray gun incorporating the invention.

A plural component spray gun is shown in FIG. 1 comprised of a handle body 10 and nozzle body 12 for supplying or spraying catalyst and resin. The handle body 10 is substantially the same as the handle body disclosed and claimed in application Ser. No. 739,667, filed Nov. 8, 1976, referred to above. The present invention provides an improvement over the prior art in providing a nozzle body assembly 12 illustrated in FIGS. 3 through 8.

Figures 3, 6:
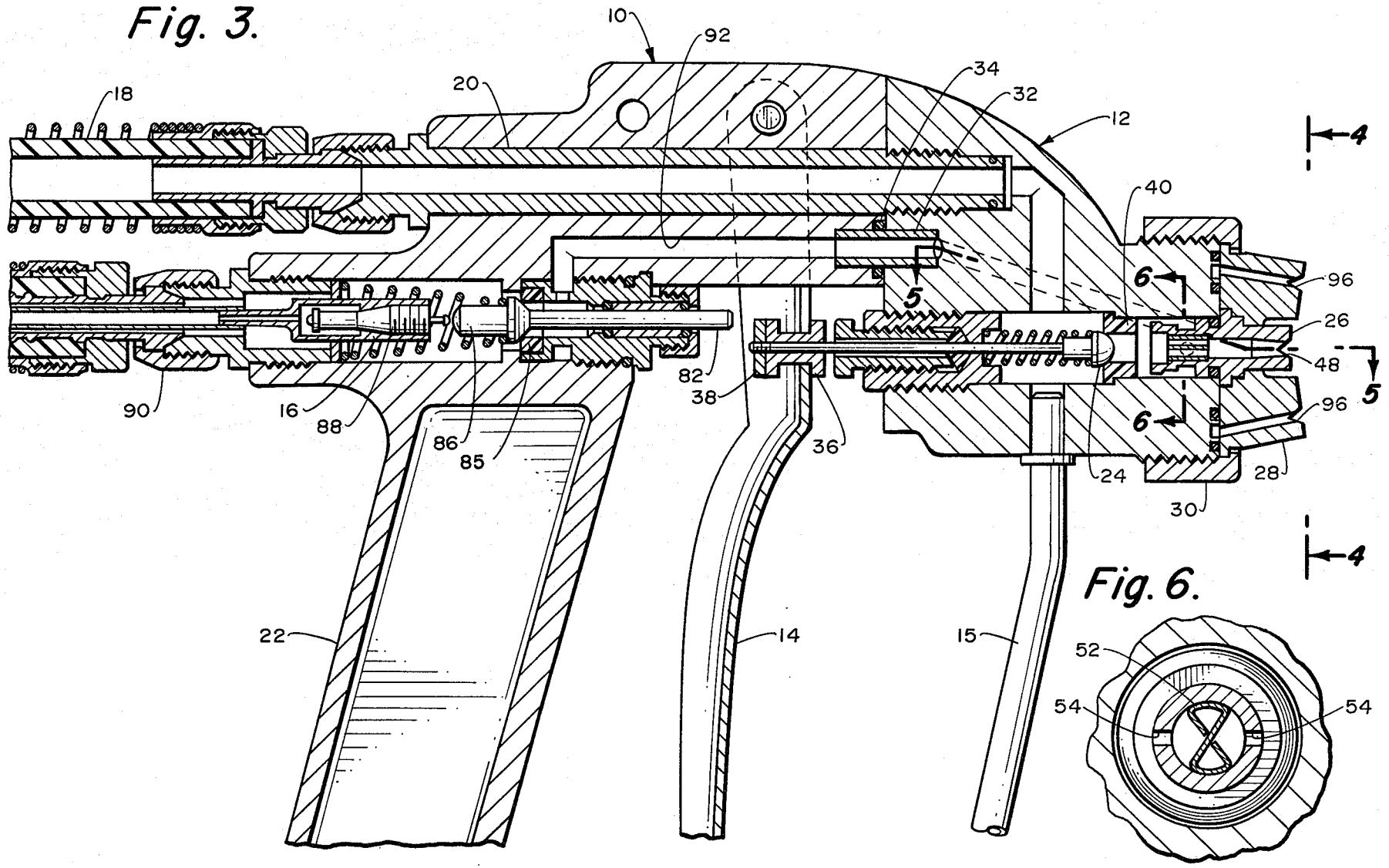
FIG. 3 is a sectional side view of the spray gun assembly of FIG. 1.
FIG. 6 is a sectional view taken at 6—6 of FIG. 3.

Details of the handle body 10 and nozzle body assembly 12 are illustrated in the sectional side view of FIG. 3. The handle body 10 has a trigger 14, trigger guard 15 and core valve catalyst delivery system in chamber 16, substantially the same as disclosed and claimed in the above-identified patent application. The nozzle body assembly 12, however, has an internal air delivery system incorporated to provide for forced air nucleation of resin or other material delivered through hose 18 and connecting feed tube 20 to the nozzle body assembly 12. The nozzle body assembly 12 has a resin valve 24 for controlling the flow of resin to fluid tip assembly 26 for external mixing with catalyst sprayed from catalyst nozzle 28. Retaining ring 30 retains catalyst nozzle 28 and resin fluid tip nozzle assembly 26 securely to the nozzle body assembly 12.

The nozzle body assembly 12 is attached to the handle body 10 by the feed tube 20 and is maintained in alignment by dowel tube 32 sealed by O-ring 34. The resin valve 24 is controlled by a collet 36 engaging the trigger 14 attached to the valve 24 by the lock nut 38. The valve 24 seals against valve seat 40 to stop the flow of resin to the fluid tip nozzle assembly 26.

Figure 5:
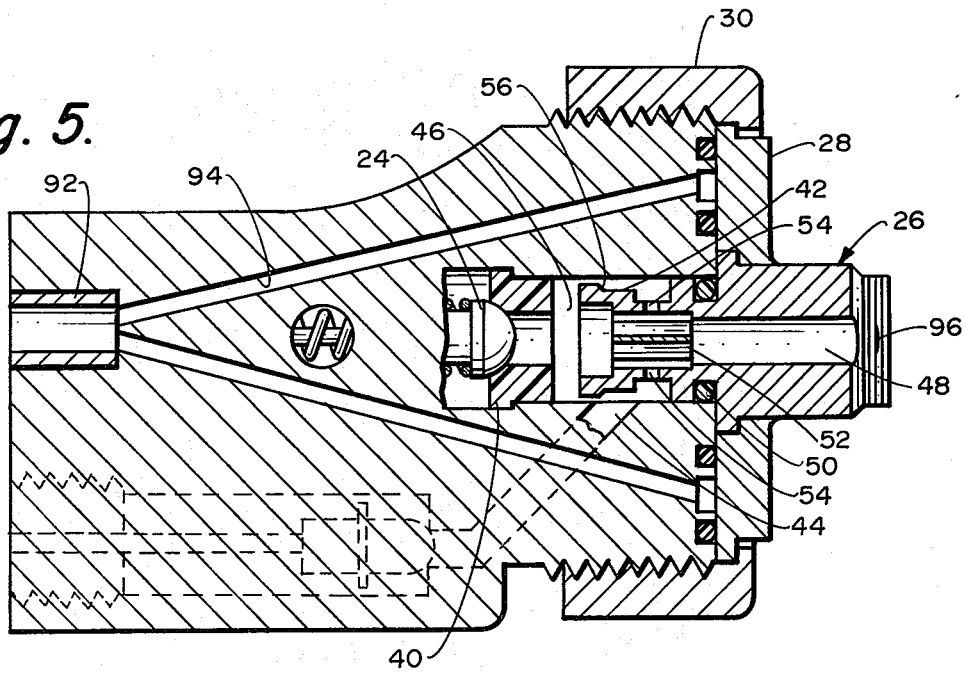
FIG. 5 is a sectional view taken at 5—5 of FIG. 3.

The fluid tip nozzle assembly 26 is shown in greater detail in the sectional view of FIG. 5. The fluid tip nozzle assembly 26 has an air deflector 42 for forcing air delivered through passageway 44 against the path of material or resin entering chamber 46 when material valve 24 is opened. The air forced against the flow of the resin through valve 24 atomizes the resin for delivery through the elliptical orifice 48 in the fluid tip nozzle assembly 26. The nozzle assembly 26 is held in place securely by the catalyst nozzle 28 and sealed by O-ring 50.

In order to provide a uniform spray from the elliptical orifice or jet 48, it is preferable to stabilize or smooth out the nucleated resin material after mixing with air in the chamber 46. To accomplish this a stabilizing vane 52 is inserted in the passageway between the chamber 46 and the orifice 48. The stabilizing vane 52 has a figure eight configuration as illustrated in FIG. 6. After nucleation or atomizing of resin the chamber 46, the vane 52 stabilizes and smooths out the turbulence created by the nucleating air providing a uniform even spray from orifice 48. Stabilization of the nucleated resin is assisted by bleed-holes 54 which permit some air to enter the fluid tip perpendicular to the flow of the nucleated resin and intersect the vane 52 at right angles. The stabilizing vane 52 and bleed-holes 54 were found to provide an even distribution of nucleated resin for delivery to the orifice 48 for external mixing with a catalyst.

The fluid tip nozzle assembly 26 has an air-deflecting shank 42 which incorporates a conical flare 56 which forces the air outward against the flow of resin. The taper of the flare 56 can be provided at various degrees but an inclusive angle of approximately 45° is preferred.

Figure 2:
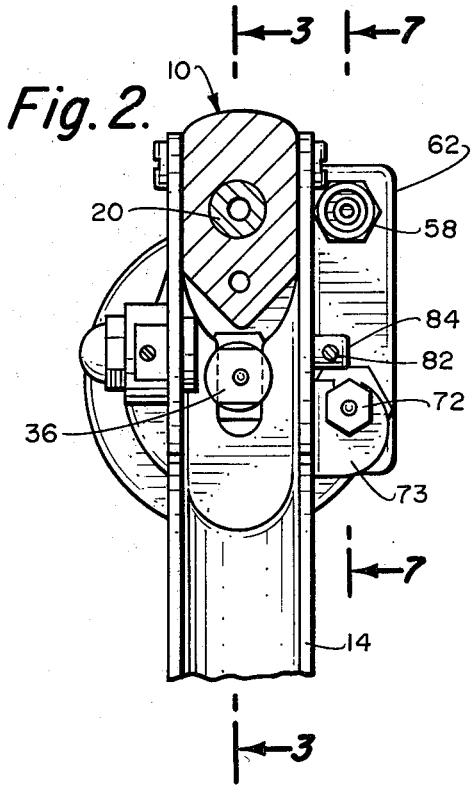
FIG. 2 is a sectional view taken at 2—2 of FIG. 1.
Figure 4:
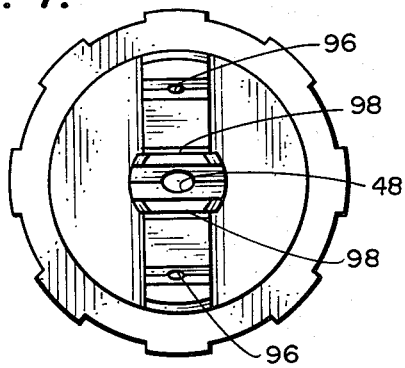
FIG. 4 is an end view of the nozzle of the spray gun of FIG. 1 taken at 4—4 of FIG. 3.

Regulated air is supplied to the nozzle body 12 through a fitting 58 for connecting an air hose 60. Air passageways to the fluid tip are provided in shoulder 62 (FIG. 2) on the nozzle body 12 and are shown in greater detail in FIGS. 7 and 8. Regulated air is supplied through fitting 58 to chamber 64 to passageway 66 leading to valve 68 in chamber 70. Operation of valve 68 permits passage of regulated air to passageway 44, leading to fluid tip assembly 26 and into the chamber 46 for nucleating the resin material.

Figure 7:
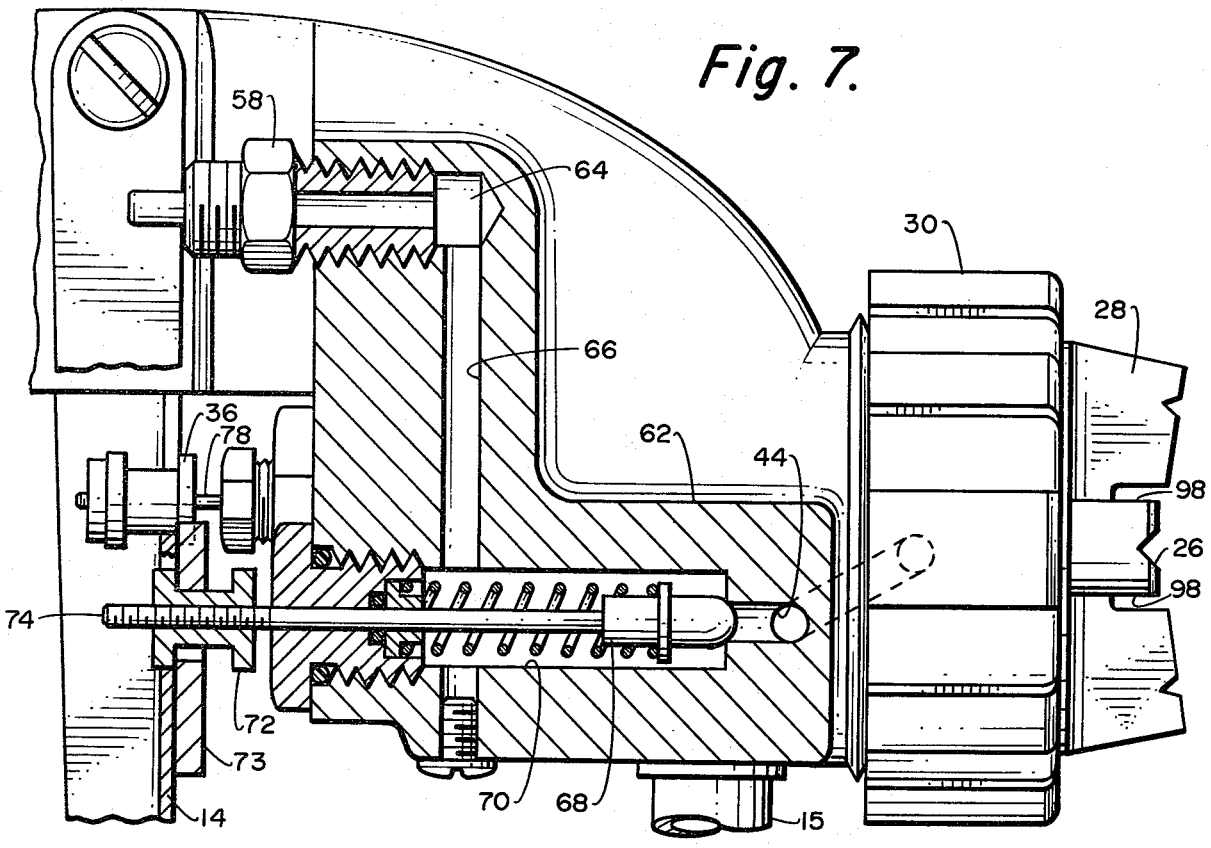
FIG. 7 is a sectional view taken at 7—7 of FIG. 2.
Figure 8:
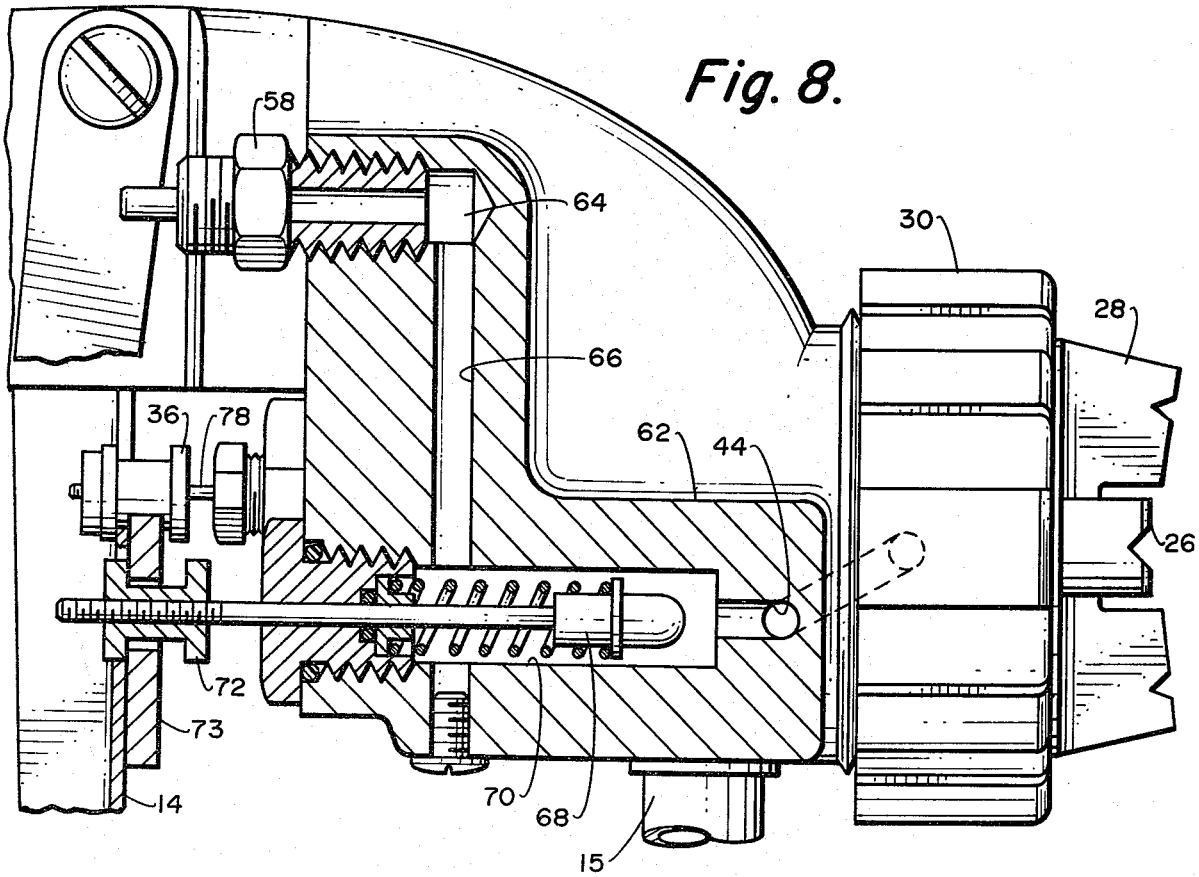
FIG. 8 is a sectional view nearly identical with the sectional view of FIG. 7 showing the sequential valve operation.

The sequential operation of the air and material valves can be seen by referral to FIGS. 7 and 8. In FIG. 7 the trigger is shown in its first position with the trigger engaging collet 72 attached to shaft 74 connected to valve 68. As the trigger 14 is depressed, valve 68 opens (see FIG. 8), allowing air to pass into passageway 44 into chamber 46 and out through orifice 48, purging the nozzle and fluid tip assembly 26. Continued depressing of the trigger 14 causes the trigger to engage a second collet 36 connected to resin valve 24 by shaft 78. Continued depressing of the trigger then opens the resin valve 24, allowing material to flow through valve seat 40 (FIG. 5) into chamber 46 for mixing with air from the air supply system.

Initial movement of the trigger 14 not only operates valve 68, but also causes the trigger to engage pushrod 82 by means of knob 84 (FIG. 1). The operation of the air in the catalyst delivery system can be seen more clearly in FIG. 3, wherein push rod 82 is dislodged from valve seat 85 before the shank 86 engages core valve 88, thus permitting air to also purge the catalyst supply passages and catalyst nozzle 28. Thus, the spray gun disclosed purges the passages with air prior to initiating delivery of catalyst and resin to the nozzles 26 and 28.

The operation of the forced air nucleating system when used in conjunction with the plural component system referred to in the above-identified pending patent application is as follows. Depressing of the trigger operates the air valve 68 in the nozzle body 12 and also operates the push rod 82, permitting air to purge the system as described hereinbefore. Continued depressing of the trigger 14 operates resin material valve 24 and core valve 88 permitting catalyst and resin to be delivered to the nozzles 26 and 28. As the shank 86 of the push rod 82 engages the core valve 88, catalyst is permitted to flow into the chamber 16 for mixture with air initially delivered through the outside hose of coaxial hose connecting system 90 for mixture with the catalyst in chamber 16 and delivery to the catalyst nozzle 28, through passageways 92 and 94 (FIG. 5) to the catalyst nozzle 28. Simultaneously resin material is delivered to the nozzle body 12 through hose 18, feed tube 20, and resin valve 24, to chamber 46 for mixture with air and delivery through fluid tip nozzle assembly 26. The force air nucleation system can also be used with a spray gun where the catalyst is not atomized in the gun, such as an atomized tank.

The catalyst spray is delivered in a fan-shaped pattern from the two catalyst jets 96 which intersect a fan-shaped resin pattern from the orifice 48 a short distance in front of the spray gun. The fan-shaped pattern from the catalyst nozzle 28 and resin fluid tip assembly 26 in the position shown will be horizontal and can be changed to any plane by loosening retaining ring 30 and rotating the nozzle assembly 26 and catalyst nozzle 28 to the desired spraying position. Flats 98 on nozzle assembly 26 engage similar flat portions of the catalyst nozzle 28 for rotation therewith. Thus, when the catalyst nozzle 28 is rotated in any direction, the fluid tip 26 rotates with it, thereby maintaining the orientation of the two nozzles and the fan-shaped pattern of the catalyst and resin for any desired position.

This simplifies use of the spray gun and permits spraying at any position without the user twisting and turning, which can result in a great deal of fatigue. Thus, if the user wishes to adjust the spray pattern to be at an angle or vertical, he simply loosens retaining ring or nut 30, rotates the catalyst nozzle 28 from the position shown 90° and retightens the retaining ring. This will then produce a vertical fan-shaped spray pattern with the intersection of the catalyst and atomized resin being maintained a short distance from the nozzle for external mixing.

Operation of the air supply valve 68 is achieved through a flange or plate 73 attached to the trigger 14 and engaging the collet 72 attached to the shaft 74 connected to operate the air valve.

Thus, there has been disclosed a plural component low-pressure spray gun allowing external mixing of two components in a predetermined fan-shaped pattern which may be varied to any angle from vertical to horizontal. The forced air nucleating nozzle body of this invention permits the elimination of high pressures allowing low-pressure external mixing of plural components. The forced air nucleating jet spray gun of the present invention is readily adaptable with only slight modification to existing equipment where solvent flushing is undesirable and is constructed for ease of operation, low maintenance and simplicity.

Obviously, many modifications and variations of the present invention are possible in light of the above teachings. It is therefore to be understood that the full scope of the invention is not limited to the details disclosed herein and may be practiced otherwise than as specifically described.

What is claimed is:

1. In a spray gun having a handle body with a trigger for controlling the flow of plural components supplied to one or more nozzles the improvement comprising:

a nozzle body attached to said handle body;

a plurality of nozzles attached to said nozzle body, each of said nozzles adapted to spray a separate component;

atomizing means for atomizing one of said components at the outlet to one of said nozzles; and said atomizing means including deflecting means for creating turbulent flow for mixing said component with forced air before delivery to said nozzle.

2. The spray gun according to claim 1 wherein said deflecting means deflects said forced air into the path of said component thereby creating said turbulent flow.

3. The spray gun according to claim 2 wherein said deflecting means deflects said forced air counter to the flow of said component.

4. The spray gun according to claim 3 wherein said deflecting means comprises:

a shank on said one nozzle adjacent to a passageway supplying air to said atomizing means.

5. The spray gun according to claim 4 wherein said shank is conically tapered outward.

6. The spray gun according to claim 5 wherein said taper has an inclusive angle of approximately 45°.

7. The spray gun according to claim 4 including:

stabilizing means inside said nozzle shank for stabilizing the flow of said atomized component after mixing with air.

8. The spray gun according to claim 7 wherein said stabilizing means comprises a stabilizing vane inserted in the nozzle passageway in said shank.

9. The spray gun according to claim 8 including:

at least one air bleed hole in said shank for injecting a small amount of air into said atomized component flowing through said nozzle.

10. The spray gun according to claim 9 including:

a pair of bleed holes in said shank;

said bleed holes being positioned so that the bleed air intersects the stabilizing vane.

11. The spray gun according to claim 8 wherein said stabilizing vane has a cross-sectional figure eight shape.

12. The spray gun according to claim 1 including:

a first valve for controlling the supply of said component to said atomizing means;

a second valve for controlling the flow of air to said atomizing means; and sequential control means for sequentially operating said second valve before said first valve whereby the nozzle body is purged with regulated air prior to receiving any component material.

13. The spray gun according to claim 12 wherein said sequential control means comprises:

a first adjustable collet on said component valve engaging the trigger;

a second adjustable collet on said air valve engaging the trigger; and said collets being adjusted so that the trigger contacts said second collet a predetermined distance before contacting said first collet.

14. A plural component spraying system comprising:

a spray gun body;

a nozzle body attached to said gun body;

a nozzle assembly having a plurality of nozzles attached to said nozzle body;

supply means for supplying a first air atomized component to one of said nozzles;

supply means for supplying a second component to another of said nozzles;

atomizing means for atomizing said second component at the outlet to said other nozzle; and said atomizing means including deflecting means for creating turbulent flow whereby said second component is mixed with said forced air before delivery to said other nozzle.

15. The spraying system according to claim 14 wherein said air supply means comprises:

connecting means for connecting an air supply directly to said nozzle body;

an air passageway in said nozzle body from said connecting means intersecting said second component supply means near said other nozzle;

valve means in said passageway for controlling the flow of air;

said deflecting means being at the intersection of said passageway and said second component supply for deflecting the air counter to the flow of said second component.

16. The spraying system according to claim 15 including:

valve means for controlling the flow of said second component to said other nozzle, said air passageway intersecting said second component supply means downstream of said second component valve means.

17. The spraying system according to claim 16 including:

valve operating means for operating air and second component valve means;

said valve operating means including means for opening the air valve means in advance of the opening of said second component valve means whereby said nozzle assembly is purged with air prior to the flow of said second component.

18. The spraying system according to claim 14 wherein said deflecting means comprises an outward flared member at the intersection of said air passageway and second component supply means whereby air is deflected outwardly counter to the flow of said second component.

19. The spraying system according to claim 18 including at least one aperture in said flared member whereby a portion of said air is injected perpendicular to the flow of said atomized second component.

20. The spray gun according to claim 18 including:

stabilizing means inside said flared member for stabilizing the flow of said atomized second component after mixing with air.

21. The spary gun according to claim 20 wherein said stabilizing means comprises a stabilizing vane inserted in the nozzle passageway in said flared member.

22. The spray gun according to claim 21 including:

at least one air bleed hole in said flared member injecting a small amount of air into said atomized second component flowing through said other nozzle.

23. The spray gun according to claim 22 including:

a pair of bleed holes in said flared member; and said bleed holes being positioned so that the bleed air intersects the stabilizing vane.

* * * * *

UNITED STATES PATENT AND TRADEMARK OFFICE

CERTIFICATE OF CORRECTION

PATENT NO. : 4175702

DATED : NOVEMBER 27, 1979

INVENTOR(S) : ROBERT D. HETHERINGTON ET AL

It is certified that error appears in the above-identified patent and that said Letters Patent are hereby corrected as shown below:

In the title, "SPARY" should be - SPRAY - .

Column 4, line 44 "force" should be - forced - .

Signed and Sealed this

*Seventeenth* Day of *June 1980*

[SEAL]

*Attest:*

SIDNEY A. DIAMOND

*Attesting Officer*

*Commissioner of Patents and Trademarks*